US006498916B2

(12) United States Patent
Yasumaru

(10) Patent No.: US 6,498,916 B2
(45) Date of Patent: Dec. 24, 2002

(54) IMAGE FORMING APPARATUS HAVING A PLURALITY OF IMAGE FORMING STATIONS

(75) Inventor: Ichiro Yasumaru, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/911,453

(22) Filed: Jul. 25, 2001

(65) Prior Publication Data

US 2002/0025194 A1 Feb. 28, 2002

(30) Foreign Application Priority Data

Jul. 27, 2000 (JP) ..... 2000/226561

(51) Int. Cl.[7] ..... G03G 15/00
(52) U.S. Cl. ..... 399/118; 399/111; 399/113
(58) Field of Search ..... 399/112, 111, 399/118, 119, 120, 107, 110, 113, 223, 258, 262, 299

(56) References Cited

U.S. PATENT DOCUMENTS 5,818,506 A * 10/1998 Yamaguchi et al. ..... 347/259
5,848,329 A * 12/1998 Aoyama et al. ..... 399/113
6,236,820 B1 * 5/2001 Nakazato et al. ..... 399/111
6,301,456 B1 * 10/2001 Horrall et al. ..... 399/111

* cited by examiner

*Primary Examiner*—Sophia S. Chen
(74) *Attorney, Agent, or Firm*—Fitzpatrick, Cella, Harper & Scinto

(57) ABSTRACT

In an image forming apparatus for forming a color image by superimposing one toner on another of a plurality of colors, a positional relationship among the image forming parts for different colors is critical. It is difficult to have a positional relationship within a desired limit among image scanning units, if a plurality of image scanning units are mounted on separate mount plates as in the above-described image forming apparatus. This may cause a color aberration. In order to obtain an image forming apparatus to solve the issue, an apparatus having high mounting accuracy of scanning unit is provided.

3 Claims, 5 Drawing Sheets

IMAGE FORMING APPARATUS HAVING A PLURALITY OF IMAGE FORMING STATIONS

BACKGROUND OF THE INVENTION

1. Field of the Invention

The present invention relates to an image forming apparatus, such as a color photocopier and a color printer, of the electrophotographic type or the electrostatic recording type.

2. Related Background Art

FIG. 5 is a schematic sectional view of an image forming apparatus for better understanding of the present invention.

As shown in FIG. 5, an image scanning unit 101 emits light A such as laser light, so that a photosensitive drum of a process cartridge 102 is irradiated with the light A. The light A, which irradiates the photosensitive drum, forms a latent image on the photosensitive drum, thereby allowing a toner image formed by specified development means to be transferred onto an endless intermediate transferring unit one after another.

The process cartridge unit 102 incorporates means for charging the photosensitive drum, or development means for forming the toner image. The toner-supplying container 104 is disposed for supplying the process cartridge 102 with toner.

A toner-supplying container 104 of larger volume requires less frequent replacement of the container; however, it ends up requiring a larger image forming apparatus. For this reason, the toner-supplying container 104 is disposed between two adjacent image scanning units 101 so that space in the apparatus can be utilized effectively.

The toner-supplying container 104 disposed between two adjacent image scanning units 101 is detachably mounted in the apparatus, since the container needs to be replaced with a new one when toner in the cartridge is used up. The toner-supplying container 104 is inserted into the image forming apparatus along the mount plate 103 for mounting the image scanning unit 101, and is mounted in the apparatus by supporting means (not shown). As described above, the toner-supplying container 104 is mounted in the apparatus by using a guide plate, for example, the mount plate 103, as a guide member, for mounting the image scanning unit 101.

In an apparatus for forming a color image by superimposing one toner on another of a plurality of colors, the positional relationship among the image forming stations for different colors is critical. It is, however, extremely difficult to have a positional relationship within a desired limit among image scanning units, if a plurality of image scanning units 101 are mounted on separate mount plates 103 as in the above-described image forming apparatus. The failure of having the positional relationship within a desired limit may cause a color aberration.

Therefore, it is envisioned that the positioning accuracy of the plurality of image scanning units is improved by mounting them on a single supporting member. However, a color image forming apparatus having a plurality of image forming stations in a tandem manner generally includes three to four image scanning units, thereby giving rise to such a problem that the supporting member becomes large accordingly, and thus it is difficult to keep enough stiffness of the supporting member.

SUMMARY OF THE INVENTION

In view of the above-described problem, it is an object of the present invention to provide an image forming apparatus with high mounting accuracy of image scanning units.

It is another object of the present invention to provide an image forming apparatus with high frame stiffness.

It is a further object of the present invention to provide an image forming apparatus having: a plurality of image forming stations for forming an image, each of the image forming stations comprising an image scanning unit and toner cartridges, the toner cartridges being detachably mountable on a main assembly of the apparatus; a supporting member for supporting the image scanning units; and a plurality of guide members for guiding the toner cartridges, wherein the plurality of guide members are fixed to the supporting members.

Further objects of the present invention will become apparent from the following description of the preferred embodiments with reference to the attached drawings.

DETAILED DESCRIPTION OF THE PREFERRED EMBODIMENTS

Referring to the attached drawings, an image forming apparatus according to an embodiment of the present invention will be described.

Figure 1:
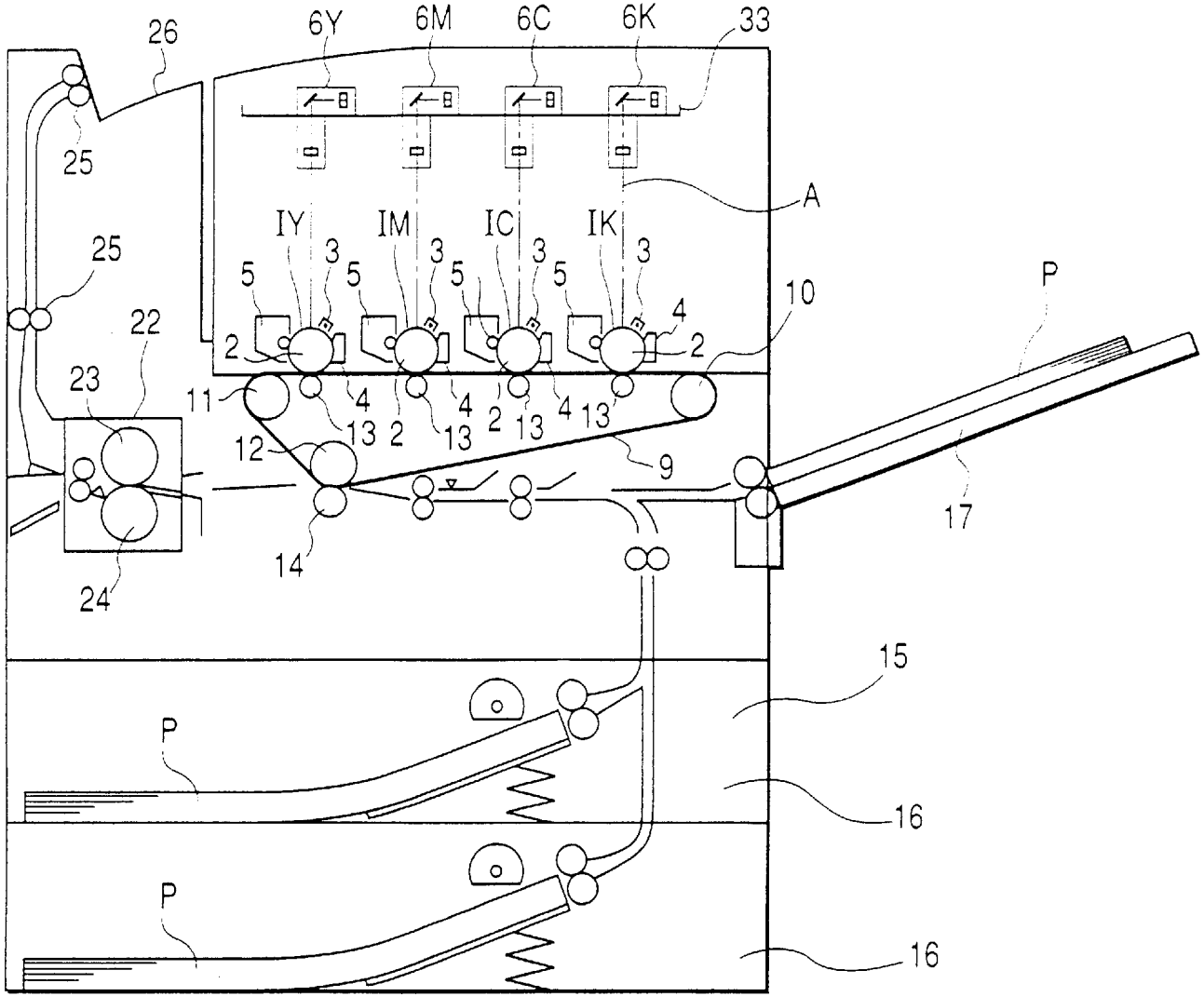
FIG. 1 is a schematic sectional view of an image forming apparatus according to the present invention.
Figure 2:
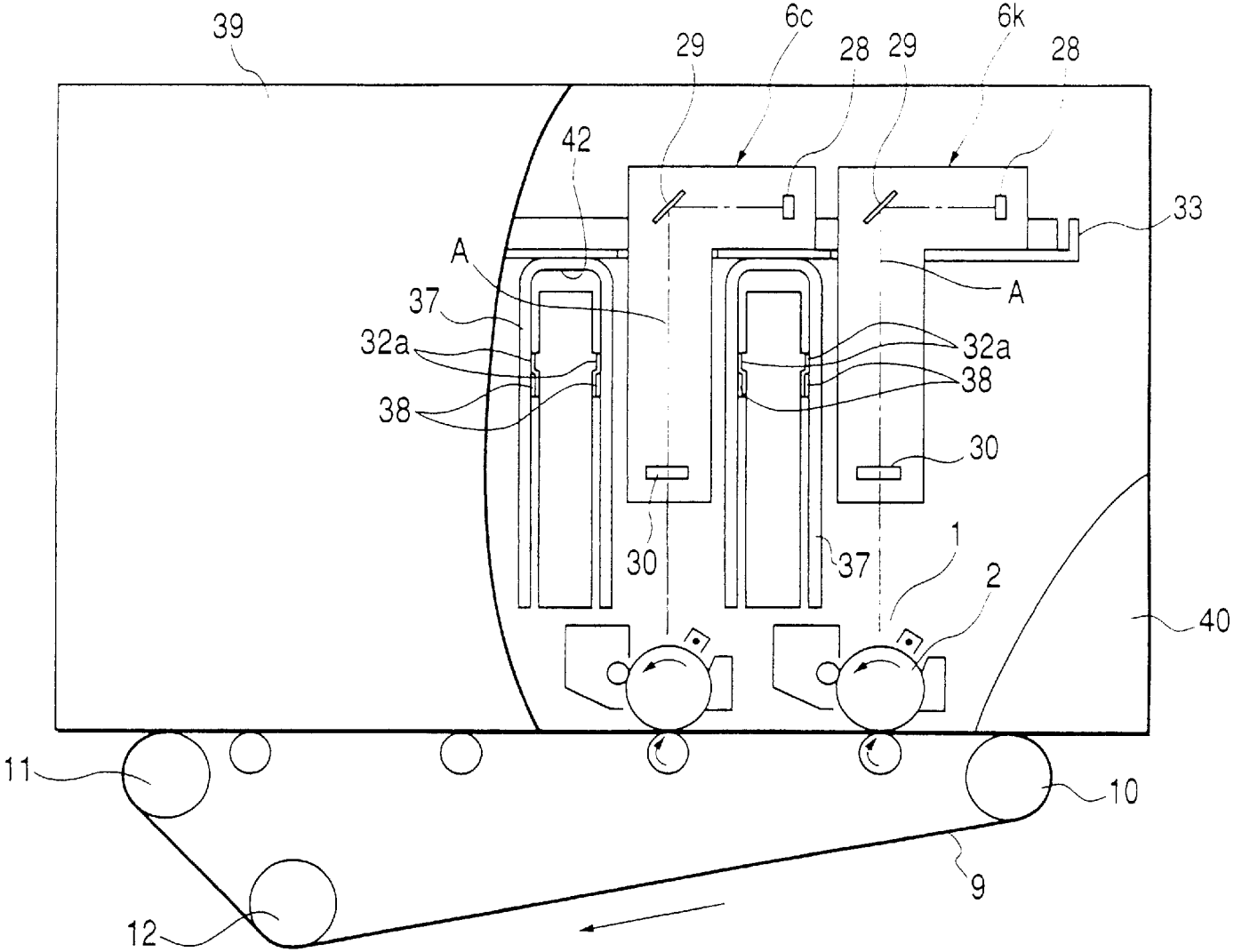
FIG. 2 is a sectional view illustrating a positional relationship among an image scanning unit, a toner-supplying container, and a guide member.
Figure 3:
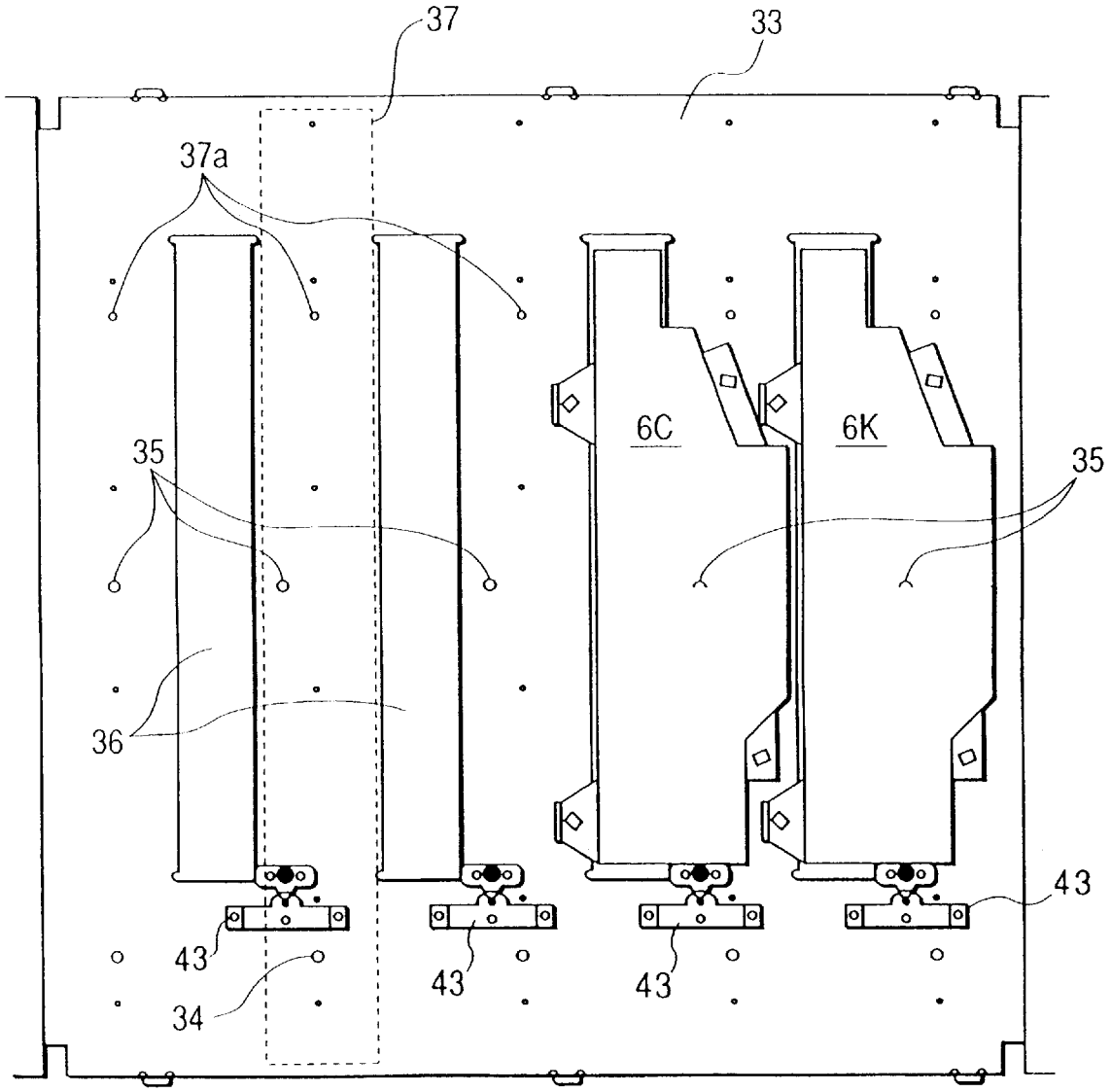
FIG. 3 is a top view of the image forming apparatus, with the top cover thereof uncovered, illustrating a positional relationship among positioning holes on supporting means and the guide member.
Figure 4:
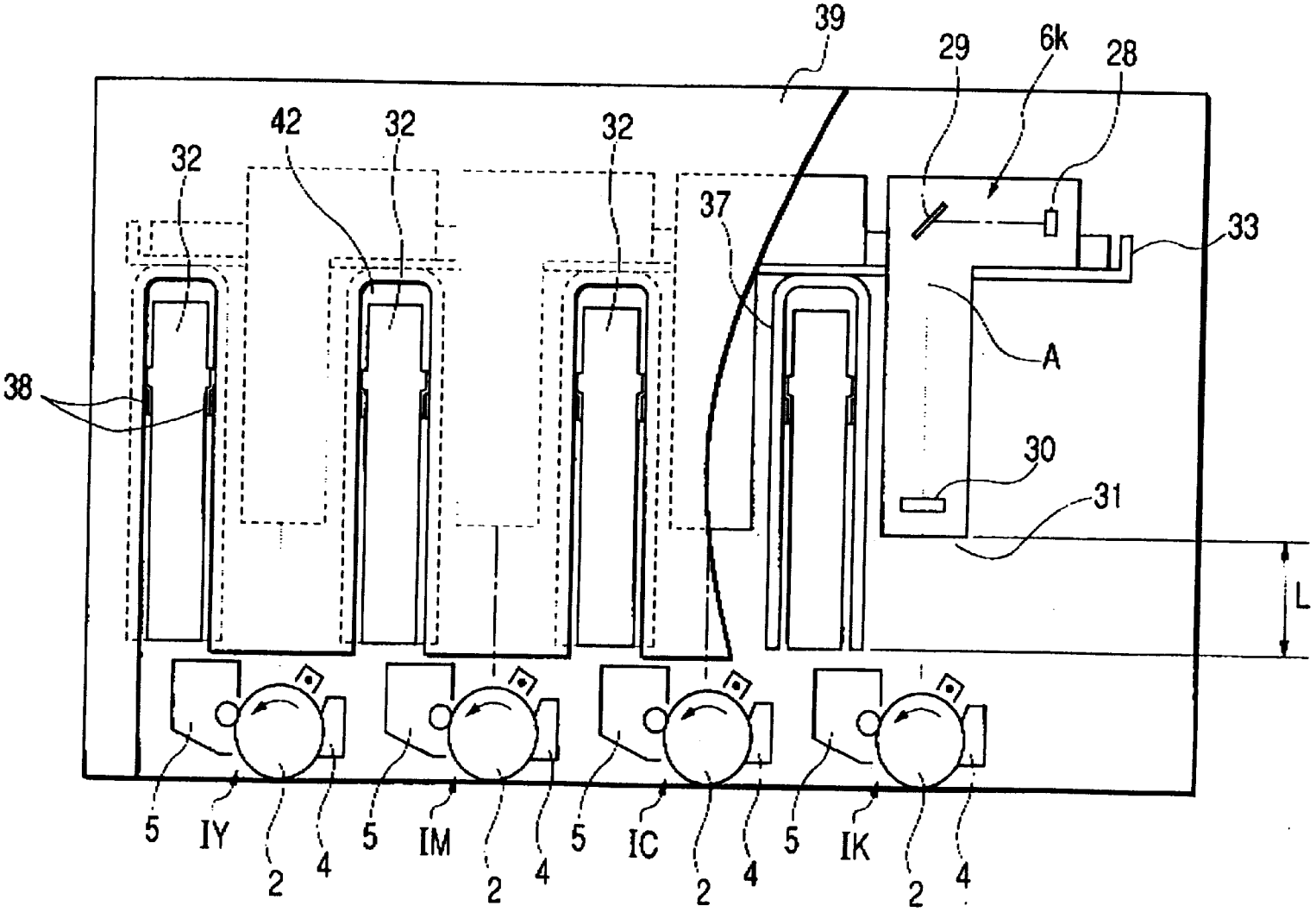
FIG. 4 is an illustration of shielding light with the guide member.
Figure 5:
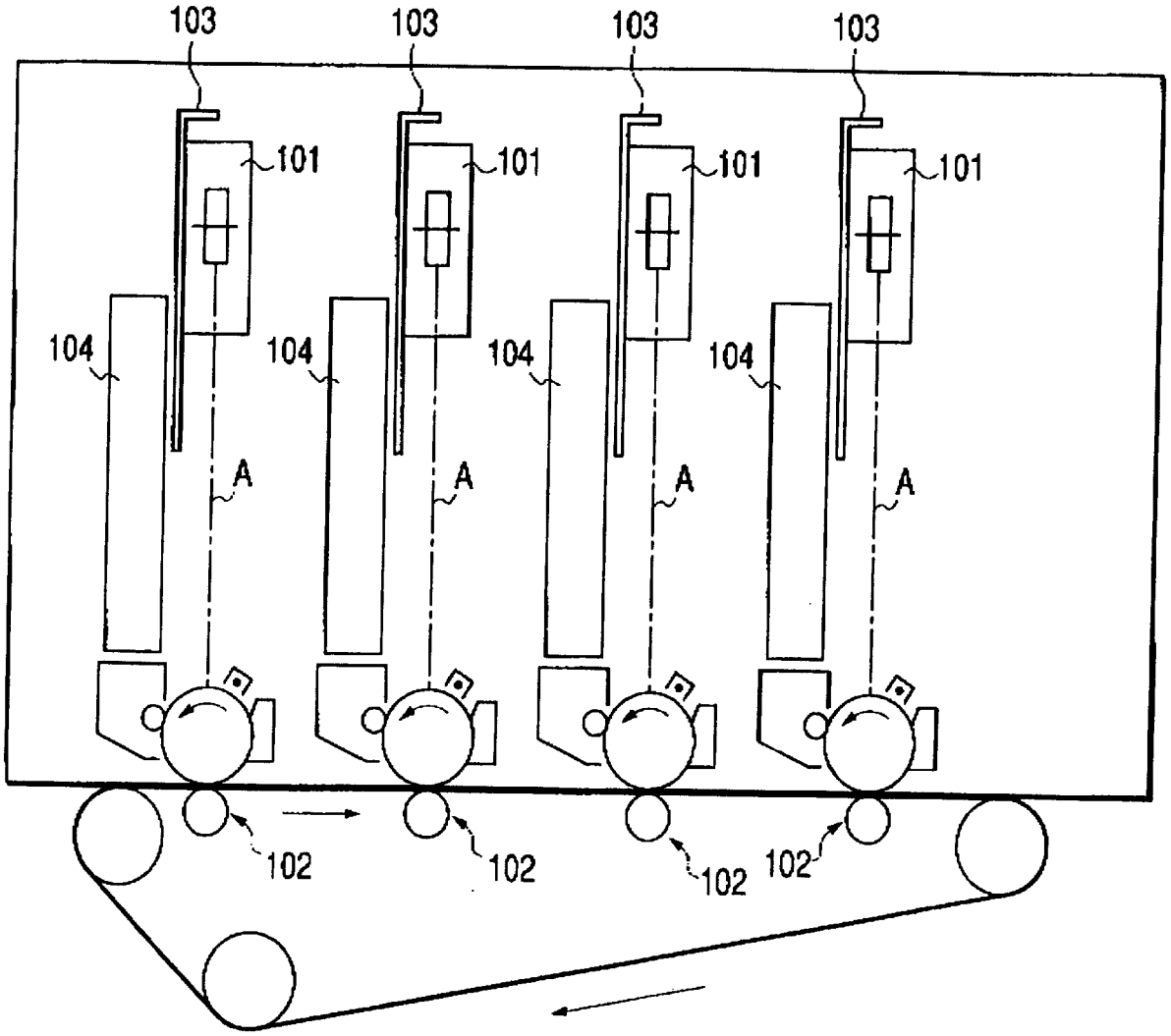
FIG. 5 is a schematic sectional view of a comparative example of the image forming apparatus according to the present invention.

FIG. 1 is a schematic sectional view of the image forming apparatus according to the embodiment. FIG. 2 is a sectional view of illustrating a positional relationship among image scanning units, toner-supplying containers, and guide members. FIG. 3 is a top view of the image forming apparatus illustrating a positional relationship among positioning holes on supporting means and the guide member. FIG. 4 is an illustration of shielding light with the guide member.

As shown in FIG. 1, the image forming apparatus according to this embodiment has four process cartridges 1Y, 1M, 1C, and 1K for four colors, which are detachable to the main assembly of the apparatus. Each process cartridge is provided with a photoreceptor (a photosensitive drum) 2, a charging device 3 for charging the photoreceptor 2, a development device 5 for replenishing the photoreceptor 2 with toner, and a cleaner 4 for cleaning the photoreceptor 2.

Further, the image forming apparatus includes the following components: four image scanning units, as optical means, 6Y, 6M, 6C, and 6K, each of which forming a latent image on the corresponding photoreceptor 2 by irradiating the photoreceptor 2 with laser light thereon; an intermediate transferring unit 8 having a transfer belt 9 for holding a toner image transferred from each of the photoreceptors 2, and rollers 10, 11, 12 for driving the belt 9; first transferring chargers (first transferring rollers) 13, each of which being mounted to the corresponding image forming station, for transferring the toner image from the corresponding photoreceptor 2 to the belt 9; a second transferring charger (a second transferring roller) 14 for transferring the toner image held on the belt 9 to a sheet of recording paper; a recording paper conveying unit 15; a fixing unit 22; and toner-supplying containers 32, detachably mounted to the main assembly, for replenishing the corresponding development device 5 with toner (see FIG. 2).

At each of the image forming stations for four colors, the image scanning unit 6 irradiates the photosensitive drum 2 with laser light A based on image information to form a latent image thereon, after the photosensitive drum 2 is uniformly charged by the charging device 3. Then, the toner-supplying container 32 replenishes the development device 5 with toner for visualizing the latent image, and the development device 5 develops the latent image formed on the photosensitive drum 2 so as to form a toner image.

The toner image formed on the photosensitive drum 2 is first transferred onto the transferring belt 9 by means of the first transferring roller 13. Upon completing the first transferring, the photosensitive drum 2 is cleaned by the cleaner 4 for forming a new image.

Through the above-described processes, the toner images of four colors are superimposed one after another on the intermediate transferring belt 9, beginning with yellow to magenta, cyan, and black in this order, in the apparatus according to the present embodiment.

Meantime, the recording paper conveying unit 15 conveys a sheet of recording paper P from a feeding cassette 16 or a feeding tray 17 to a second transferring area, and the toner image formed on the transferring belt 9 is transferred to the sheet P by means of the second transferring roller 14.

The sheet P having the toner image thereon is conveyed to the fixing unit 22, and discharged onto a discharge tray 26 by means of discharge rollers 25 after the toner image is fixed at a nip between a fixing roller 23 and a pressure roller 24.

Now, a positional relationship between the image scanning unit 6 and the toner-supplying container 32 will be described. The following descriptions will be provided for a set of the image scanning unit 6 and the toner-supplying container 32, because the four image scanning units 6 and the four toner-supplying containers 32 are mounted in the apparatus in an alternate arrangement, corresponding to the process cartridges 1Y, 1M, 1C, and 1K. Besides, the image scanning units 6 have the same structure and the containers 32 have another same structure.

Having an L-shape structure, the image scanning unit 6 is pivotably mounted to a supporting member 33 and a part of the unit 6 is inserted into the supporting member 33. Laser light, emitted by a light emitting source 28, is deflected at a polygon mirror (not shown), diffracted at a mirror 29, passes through a lens 30, and then irradiates the photosensitive drum 2 of the process cartridge 1. Because of the L-shape structure of the image scanning unit 6 as described above, the image scanning unit 6 is readily adjustable in position relative to the photosensitive drum 2, thereby allowing an image to be formed with a small amount of deviation from perfect alignment.

The supporting member 33, which is a single sheet for supporting four image scanning units, is fixed to a front side plate 39 and a back side plate 40 by screws or the like, respectively, at the front and the back of the apparatus. Four guide members 37 forming four housing chambers for housing the toner-supplying containers 32 are fixed to the supporting member 33. These guide members are also fixed to the side plates 39 and 40 by screws or the like.

The guide member 37 with a U-shape structure formed by bending a single sheet metal is designed to form the housing chamber for housing the toner supplying container 32 so that the toner supplying container 32 does not contact the adjacent image scanning unit 6. Since the guide member 37 has a U-shape structure made from a single sheet metal as described above, opposing ends of the U-shape tend to move outward and inward. To prevent this movement, the front and back sides of the U-shape, as viewed in the direction of mounting the toner supplying container, are screwed to the front side plate 39 and the back side plate 40, respectively, and also the bottom of the U-shape is fixed to the supporting member 33 by screws or the like, thereby allowing the opposing sides of the guide member 37 to keep a specified distance with each other. With this arrangement, the supporting member 33 is supported not only by the side plates 39 and 40, but also by the four guide members 37 fixed to the side plates 39 and 40, thus having high stiffness, even though the supporting member 33 is a large single sheet metal for supporting the four image scanning units 6. A guide rail 38 for guiding the toner-supplying container 32 is disposed on the inner surface of the U-shape guide member 37.

The guide rail 38 is screwed onto the inner surface of the guide member 37. A rail portion 32*a* of the toner-supplying container 32 is slidable on the guide rail 38 so that the toner-supplying container 32 can be attached and detached. The guide rail 38 may be integrally built in the guide member 37 by bending a part of the guide member 37 made from a sheet metal and the like into a rail shape.

Referring now to FIG. 3, a relationship between the guide member 37 and the supporting member 33 will be described in further detail.

The guide member 37 is precisely positioned to the supporting member 33 with reference to a locating point 37*a*, and is fastened to the supporting member 33 at a screw hole 34 with a screw. A light emitting side (a side opposing to the photosensitive drum) of each of is the image scanning units 6Y, 6M, 6C, and 6K is inserted into a rectangular slot 36 provided at the supporting member 33. Each of the image scanning units 6 is then mounted to the supporting member 33 with reference to a fit reference hole 35. The unit 6 is also pivotably adjustable relative to the fit reference hole 35.

Since the guide 37 is precisely positioned with reference to the locating point 37*a*, the guide member 37 is also precisely positioned with reference to the fit reference hole 35 formed in the same member as the locating point 37*a*. Accordingly, the guide member 37 Is precisely positioned relative to the rectangular slot 36, and thus maintains its precise positional relationship with the image scanning unit 6. The supporting member 33 for pivotably adjusting the image scanning unit 6 has an adjusting plate 43 moveable in the lateral direction of the rectangular slot 36.

The image scanning unit 6 is provided with a fit hole into which a fit shaft (not shown) of the adjusting plate 43 is fitted, and is pivotably adjusted relative to the fit reference hole 35, when the adjusting plate 43 moves in the lateral direction of the rectangular slot 36. A certain adjustable range is necessary in order to adjust the image scanning unit 6. The maximum adjustable range is determined based on clearance between the image scanning unit 6 and the rectangular slot 36 when the image scanning unit 6 is inserted into the rectangular slot 36. More particularly, viewed from the top, the guide member 37 indicated by a dashed line in FIG. 3 is configured not to lie inside the rectangular slot 36.

Referring now to FIG. 4, there will be described a relationship between the image scanning unit 6 and the toner-supplying container 32, when the toner-supplying container 32 is inserted into a housing chamber formed from the guide member 37.

The guide member 37 is provided with the guide rail 38, along which the toner-supplying container 32 is slidably inserted when the toner supplying container is inserted. While being inserted, the toner-supplying container 32 may contact the guide member 37 since the toner supplying container 32 swings from side to side.

The image scanning unit 6 is, however, supported not to contact the guide member 37 as described above, and therefore the image scanning unit 6 is not influenced when the toner-supplying container 32 collides with the guide member 37 and presses or vibrates it during insertion.

The guide member 37 extends further by L in the light axis direction from a light opening 31 for emitting light of the image scanning unit 6, thus reaching substantially close to the process cartridge 1. The front side plate 39 covers the entire side, except the insertion openings 42 for inserting and taking out the toner supplying containers 32. The back side plate 40 covers the entire side opposite to the insertion openings 42. With this arrangement, after coming out from the light opening 31 of the image scanning unit 6, light emitted from the image scanning unit 6 is shielded, by the guide member 37. Accordingly, there is no light leakage in the process for irradiating the process cartridge 1 with light, and no risk that hazardous light enters the eyes of an operator while replacing the toner-supplying container 32 with a new one.

The supporting member 33 has higher stiffness because of reinforcement by the four guide members 37 as described above.

In addition, the guide member 37 creates a partition between the image scanning unit 6 and the adjacent toner-supplying container 32. This partition allows the toner-supplying container 32 to be inserted into the main assembly of an image forming apparatus without contact with the adjacent image scanning unit 6, and thus allows the image scanning unit 6 to be supported accurately in a predetermined location at all times.

Further, the plurality of guide members 37 serves to block a light path of the image scanning unit and to prevent leakage of laser light emitted by the light sources of the image scanning units 6. Consequently, there is provided an image forming apparatus which offers a high level of safety such that hazardous light does not enter the eyes of an operator while replacing the toner-supplying container 32 with a new one.

The present invention is not limited to the above-described embodiment and various modifications can be made within the spirit and scope of the technical ideas defined in the appended claims.

What is claimed is:

1. An image forming apparatus comprising:

a plurality of image forming stations for forming an image, each of said plurality of image forming stations including an image scanning unit and a toner cartridge, said toner cartridges being detachably mountable on a main assembly of said apparatus;

a supporting member for supporting said image scanning units; and a plurality of guide members for guiding said toner cartridges, wherein said plurality of guide members have a U-shaped structure and are made from a single sheet metal, and wherein said plurality of guide members are fixed to said supporting member at the bottom of the U-shaped structure.

2. An image forming apparatus according to claim 1, wherein said supporting member is fixed to a side plate of said main assembly, and said plurality of guide members are further fixed to said side plate.

3. An image forming apparatus according to claim 1, wherein said supporting member is plate shaped.

* * * * *

UNITED STATES PATENT AND TRADEMARK OFFICE

CERTIFICATE OF CORRECTION

PATENT NO. : 6,498,916 B2
DATED : December 24, 2002
INVENTOR(S) : Yasumaru

It is certified that error appears in the above-identified patent and that said Letters Patent is hereby corrected as shown below:

Column 3,
Line 44, “same” should read -- identical --.

Column 4,
Line 46, “Is” should read -- is --.

Signed and Sealed this

Fourth Day of November, 2003

JAMES E. ROGAN
*Director of the United States Patent and Trademark Office*